US006099350A

United States Patent [19]

Wright

[11] Patent Number: 6,099,350

[45] Date of Patent: Aug. 8, 2000

[54] CONNECTOR AND CONNECTOR ASSEMBLY

[75] Inventor: John O. Wright, York, Pa.

[73] Assignee: Osram Sylvania Inc., Danvers, Mass.

[21] Appl. No.: 09/393,620

[22] Filed: Sep. 10, 1999

[51] Int. Cl.[7] ..... H01R 9/05

[52] U.S. Cl. ..... 439/582; 439/352; 439/557

[58] Field of Search ..... 439/582, 578, 439/675, 352, 144, 353, 923, 357, 557

[56] References Cited

U.S. PATENT DOCUMENTS 3,745,514 7/1973 Brishka ..... 339/91 R
4,017,139 4/1977 Nelson ..... 339/91 R
4,915,642 4/1990 Lin et al. ..... 439/352
6,036,540 4/1990 Beloritsky ..... 439/582

*Primary Examiner*—Gary F. Paumen
*Assistant Examiner*—Chi Nguyen
*Attorney, Agent, or Firm*—William H. McNeill

[57] ABSTRACT

A connector includes a contact extending in a first direction of a longitudinal axis. The contact is adapted for connection at one end to a mating contact extending in the first direction, and for connection at an opposite end to a conductor extending in a second direction that extends at an angle to the first direction. The connector includes a spring element that urges the connector away from a mating connector if the two are not fully engaged. A connector assembly including such a connector.

20 Claims, 5 Drawing Sheets

CONNECTOR AND CONNECTOR ASSEMBLY

TECHNICAL FIELD

The present invention relates to a connector that includes a male or female contact extending in a first direction that is electrically and mechanically connected to a conductor that extends in a second direction that is at an angle relative to the first direction. A connector assembly that includes such a connector is also provided.

BACKGROUND ART

The connector and connector assembly of the present invention is illustrated herein with reference to an antenna connector and connector assembly. However, it will be apparent to those skilled in the art that the connector and connector assembly of the present invention is not limited to such an application.

The use of a radio antenna connected to a radio within an automobile is well known. One of the concerns regarding such an antenna is the integrity of the electrical and mechanical connection provided by the mating connectors that are attached to a coaxial antenna cable and a radio socket, respectively. Efforts to tighten-up on such connections provide mating male and female connectors that are difficult to couple together and to uncouple. However, it is desired that the male and female connectors be readily connected and disconnected, as desired. In some prior art devices the lack of satisfactory tactile feedback makes it difficult to know when a suitable connection has been made. In addition, providing a satisfactory ground may present a concern in some applications. Further, the presence of such a connector assembly often takes up more space behind the radio than desired. Efforts to bend the cable relative to the connector attached thereto in an effort to fit the connector in the space provided or otherwise route the cable require that the cable be clamped to provide the necessary bend in the cable. Such clamping requires one or more additional parts and takes up additional space.

SUMMARY OF THE INVENTION

It is an object of the present invention to provide an improved connector.

Another object of the present invention is to obviate the disadvantages of the prior art by providing an improved connector.

A further object of the present invention is to provide a connector that provides the required electrical and mechanical connection between male and female connectors and yet may be readily connected and disconnected.

It is still another object of the present invention to provide a connector that provides tactile feed-back.

Another object of the present invention is to provide a connector that provides improved grounding.

A further object of the present invention is to provide a connector that is compact.

Yet another object of the present invention is to provide an angled connector that permits a conductor to extend at an angle relative to the connector contact to that the conductor is connected.

Another object of the present invention is to provide a connector assembly that achieves one or more of the foregoing objects.

Yet another object of the present invention is to provide a connector assembly that prevents latching of one connector to another until full engagement is made.

Yet another object of the present invention is to provide an improved connector assembly for electrically and mechanically connecting an antenna cable to a radio socket.

This invention achieves these and other objects by providing a connector that comprises a housing comprising an insulator extending in a first direction of a longitudinal axis from a front end to a rear end. An appendage comprising a first channel extends from the insulator in a second direction that extends at an angle relative to the longitudinal axis. A contact extends through the insulator in the first direction from one end to another end. The contact is structured and arranged for electrical connection with a mating contact, of a mating connector, in the first direction, and with a conductor extending through the first channel in the second direction. A conductive shell is provided that comprises a first portion extending in the first direction from an engagement end to an opposite actuation end. The shell is attachable to the insulator. The first portion comprises at least one beam extending in the first direction towards the engagement end. The beam comprises a first latch element attachable to the mating connector. The conductive shell also comprises a second portion that comprises a second channel extending in the second direction. The second portion is structured and arranged for insertion into the first channel to retain the conductor between the first channel and the second channel. A resilient clement is provided adjacent the actuation end. An actuator is attached to the first portion at the actuation end and is slidable in the first direction towards and away from the front end. The resilient element is disposed between the actuator and the first portion and provides resilience for the actuator relative to the actuation end. The actuator is (a) engagable with the beam when urged towards the front end against such resilience to pivot the beam and the first latch element towards the longitudinal axis in a first mode, and (b) disengagable from the beam when urged by the resilient clement away from the first end thereby permitting the beam and the first latch to resile away from the axis in a second mode.

A connector assembly that comprises the connector of the present invention is also provided.

BRIEF DESCRIPTION OF THE DRAWINGS

This invention may be clearly understood by reference to the attached drawings in that like reference numerals designate like parts and in that.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
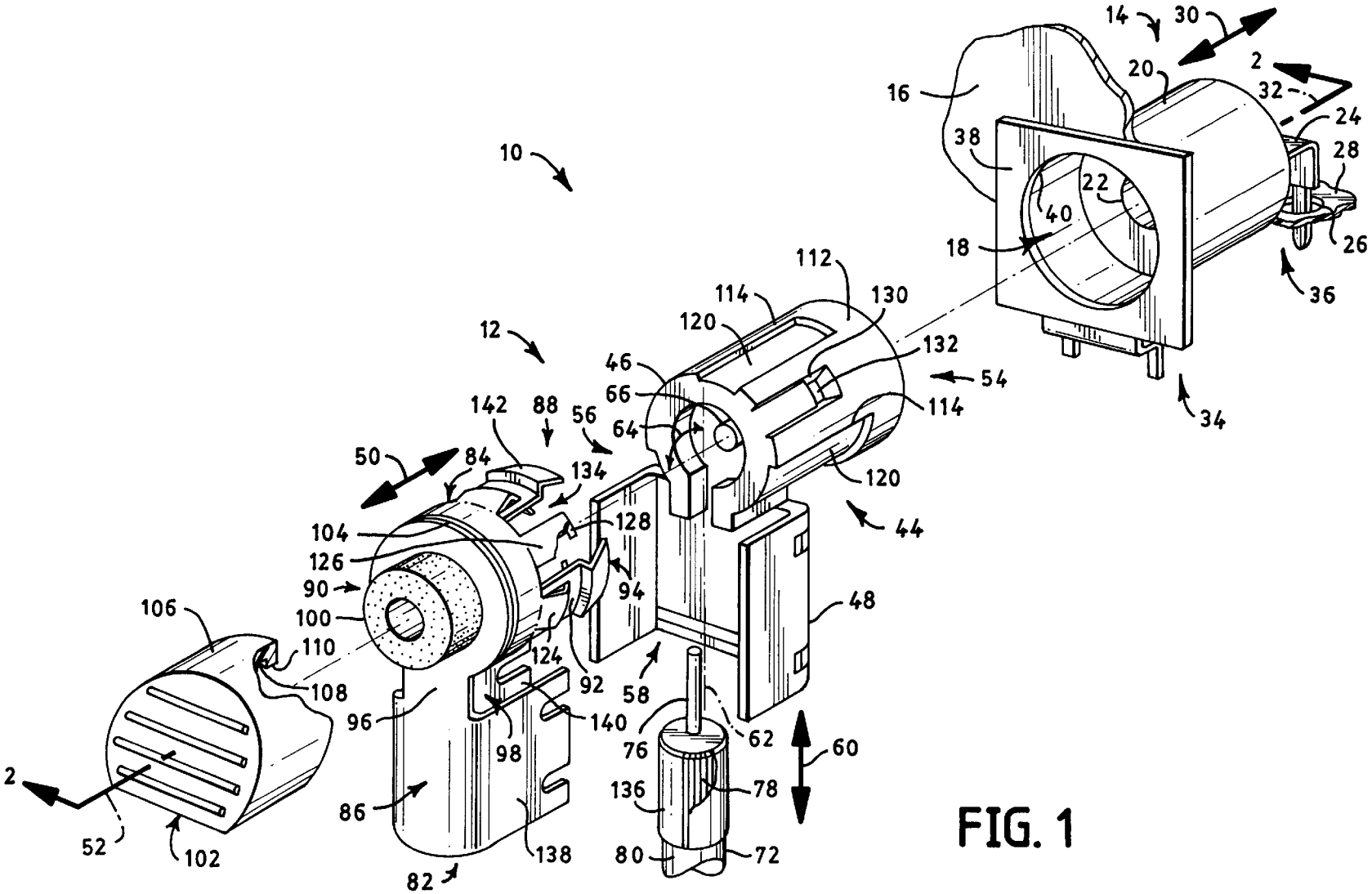
FIG. 1 is an exploded view of one embodiment of the connector assembly of the present invention.
Figure 2:
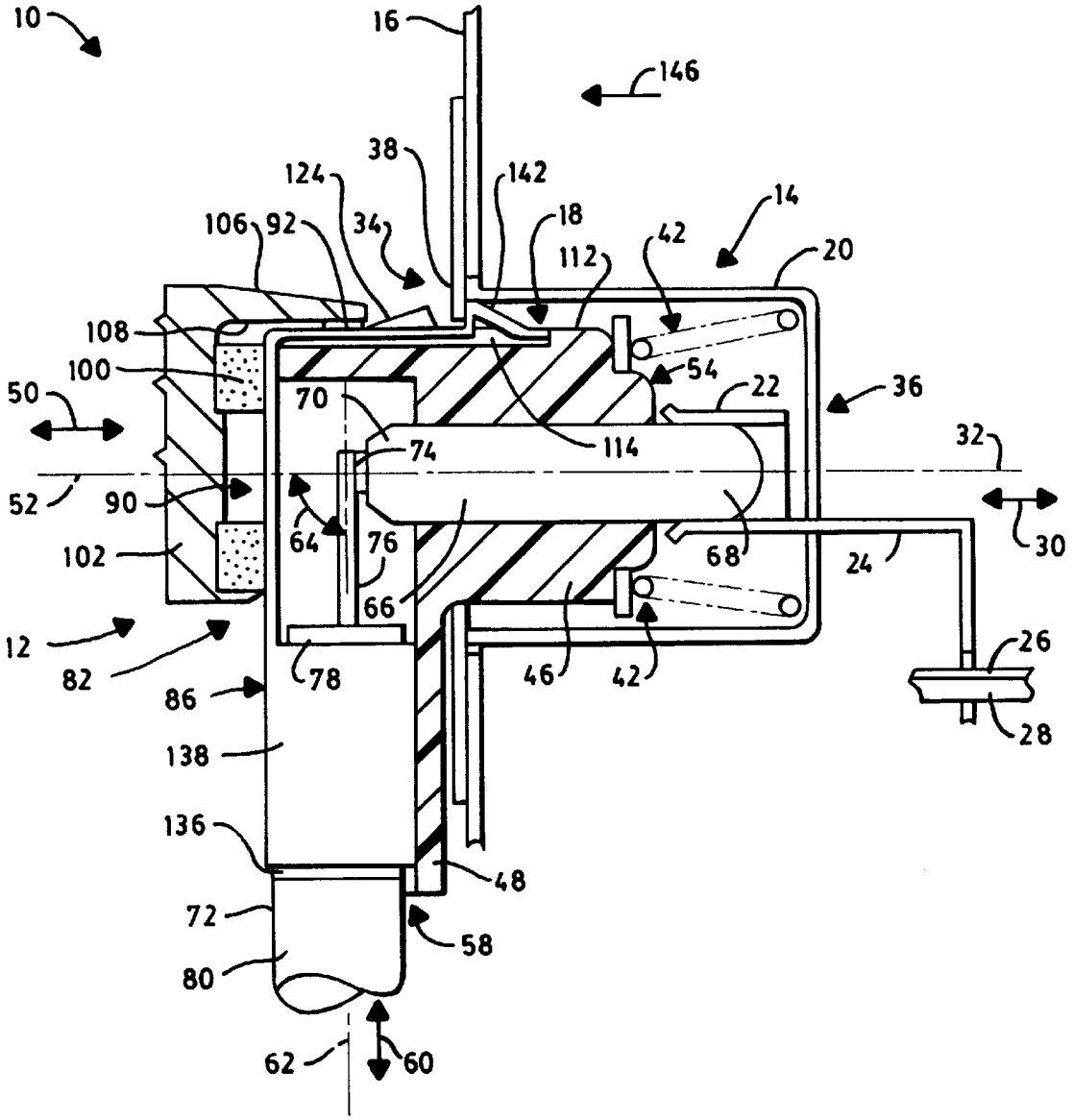
FIG. 2 is a sectional view of FIG. 1 taken along lines 2—2.

Referring to the drawings, FIGS. 1 and 2 illustrate a connector assembly 10 that comprises a first connector 12 and a mating second connector 14. The connector 12 is a male connector, and the connector 14 is a female connector, although connector 12 could be a female connector and connector 14 could be a male connector, if desired.

Without limitation, the connector assembly 10 is useful in the connection of an antenna in an automotive environment. In the embodiment illustrated in FIGS. 1 and 2, the connector 14 is attached to an automobile surface 16 in a conventional manner to provide a socket 18. The connector 14 comprises a housing 20 having a female the contact 22 therein. Contact 22 may be in the form of a typical female contact formed by a ferrule in a conventional manner. Contact 22 includes a tab 24 electrically and mechanically connected to a circuit 26 of a circuit board 28 in a conventional manner.

The housing 20 extends in direction 30 of a longitudinal axis 32 from a forward end 34 to a rearward end 36. The housing 20 may be fabricated from a conductive (metal) material in a conventional manner. Housing 20 comprises a lip 38 adjacent the forward end 34. The lip 38 comprises an abutment surface 40 facing the rearward end 36. A spring element diagrammatically illustrated at 42 is disposed within the housing 20. The connector 12 is electrically and mechanically connectable to, and disconnectable from, the connector 14 in an engaging and a disengaging mode, respectively, as described hereinafter.

The connector 12 comprises a housing 44 that comprises an insulator 46 and an appendage 48. The housing 44 may be fabricated from a plastic material in a conventional manner. The insulator 46 extends in direction 50 of a longitudinal axis 52 from a front end 54 to a rear end 56. The appendage 48 comprises a channel 58 that extends from the insulator 46 in a direction 60 of axis 62 that extends at an angle 64 relative to axis 52. Without limitation, in the embodiment illustrated in FIGS. 1 and 2, the angle 64 is 90°.

A contact 66 extends through the insulator 46 in direction 50 from one end 68 to another end 70. The contact 66 may be in the form of a typical male contact formed by a prong in a conventional manner. The end 68 of the contact 66 is structured and arranged for electrical connection with the contact 22 of the connector 14 in a conventional manner. The other end 70 of the contact 66 is connected to a conductor 72 in a conventional manner as, for example, by soldering at 74. Without limitation, conductor 72 comprises a coaxial cable having a conventional central conductor 76, a shield 78 and an outer jacket 80. The conductor 72 extends through the channel 58 in direction 60 and forms an the angle 64 with the contact 66 thereby providing the desired angled connector.

A conductive shell 82 is provided comprising a first portion 84 and a second portion 86. The portion 84 extends in direction 50 from an engagement end 88 to an opposite actuation end 90. The portion 84 is attachable to the insulator 46. To this end, the portion 84 comprises at least one resilient beam.

In the embodiment illustrated in FIGS. 1 and 2, the portion 84 comprises a plurality of resilient beams 92 that extend in the direction 50 towards the engagement end 88. Each beam 92 comprises a latch element 94 that is attachable to the connector 14 as described hereinafter. The portion 86 is joined to the portion 84 by a bridging portion 96. The portion 86 comprises a channel 98 that extends from portion the 84 in the direction 60 of the axis 62 and therefore extends at the angle 64 relative to the axis 52. The portion 86 and the channel 98 are structured and arranged for insertion into the channel 58 in the direction 50 to retain the conductor 72 between the channels 58 and 98.

A resilient element 100 is provided adjacent the actuation end 90 of the portion 84 of the a shell 82. An actuator such as a push button actuator 102 is attached to the portion 84 at the actuation end 90 and is slidable in direction 50 towards and away from the front end 54 of insulator 46. To this end, the actuation end comprises a shoulder 104. The actuator 102 comprises a wall 106 that is structured and arranged to snap-fit over the shoulder 104 in direction 50 towards the engagement end 88. For example, the inner surface 108 of the wall 106 includes an annular inner flange 110 and is sufficiently resilient to snap-over shoulder 104 to slidably attach the actuator 102 to the portion 84 of the shell 82. The resilient element 100 is disposed between the actuator 102 and the actuation end 90 adjacent the portion 84. The resilient element 100 may be a conventional spring or an elastomeric member or any other resilient member that functions as described herein to provide resilience for the actuator relative to the actuation end by providing resistance against the actuator 102 when it is urged by the user towards the actuation end 90, and to resile and urge the actuator away from the actuation end and into engagement with the shoulder 104 when the actuator is released by the user. In the embodiment illustrated in the drawings, the resilient element 100 is a doughnut shaped elastomeric element.

Figure 3:
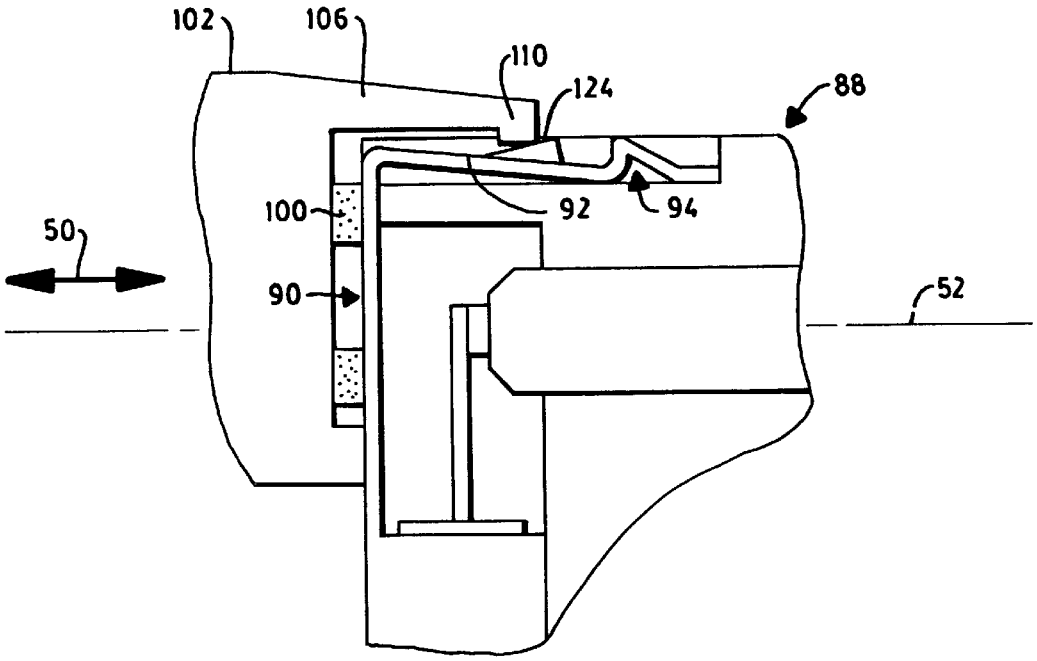
FIG. 3 is a sectional view illustrating the connector of the connector assembly of FIG. 1 in a first mode.
Figure 4:
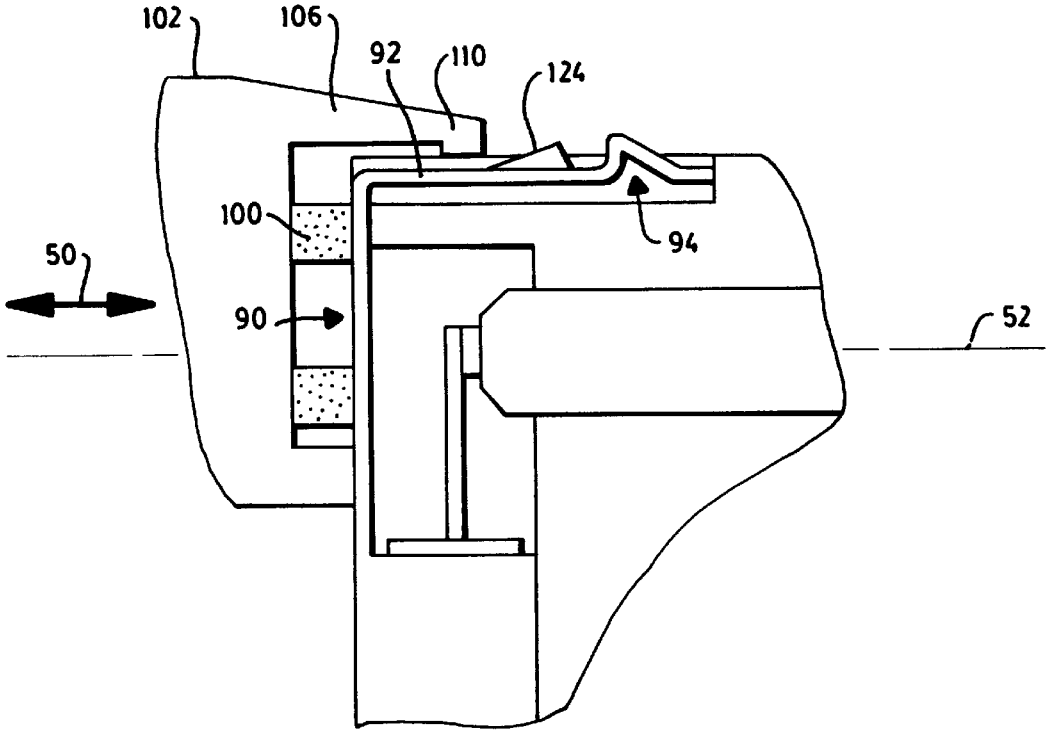
FIG. 4 is a sectional view illustrating the connector of the connector assembly of FIG. 1 in a second mode.

In the embodiment illustrated in FIGS. 1 and 2, the insulator 46 comprises an the outer surface 112. Outer surface 112 may comprise at least one depression. In the embodiment of FIGS. 1 and 2, the outer surface 112 comprises a plurality of depressions 114 that extend in the direction 50 between the ends 54 and 56. As illustrated in FIGS. 3 and 4, each beam 92 comprises a segment 116 that extends towards a distal end 118 and the front end 54 of the insulator 46. Each segment is substantially entirely disposed within the depression 114. Each distal end 118 includes a portion that extends radially away from the axis 52 and out of a respective the depression 114 to form a respective the latch element 94. Each beam 92 is cantilevered and extends above a base 120 of a respective depression 114 a distance 122. In the embodiment illustrated in the drawings, each beam 92 comprises a raised ramp 124. With reference to FIG. 3, the actuator 102 may be caused to slide towards actuation end 90 to compress resilient element 100 so that the flange 110 of the wall 106 engages the raised ramps 124 in a first mode to pivot the resilient beams 92 and the latch elements 94 towards axis 52. Similarly, with reference to FIG. 4, the actuator 102 may be caused to disengage the raised ramps 124 in a second mode by sliding the actuator away from actuation end 90 thereby permitting the resilient beams 92 and the latch elements 94 to resile away from axis 52. During such second mode, the resilient element 100 resiles away from the actuation end 90 to urge the actuator 102 away from the actuation end and to cause the flange 110 of the wall 106 to disengage the latch elements 94.

In the embodiment illustrated in FIGS. 1 and 2, the portion 84 comprises at least one of resilient tab 126 that extends in direction 50 towards the engagement end 88. Each tab comprises a latch element 128. Insulator 46 comprises at least one recess 130 that is aligned with the tab 126 and comprises a latch element in the form of indent 132. The shell 82 may be attached to the insulator 46 by inserting the end 56 of the insulator in the direction 50 into the cavity 134 of the shell such that the tab 126 mates with recess 130 and latch element 128 snaps into indent 132. Tab 126 is substantially entirely disposed within recess 130.

In the embodiment illustrated in FIGS. 1 and 2, the channel 98 is adapted for electrical connection with the shield 78 of the conductor 72. For example, in the embodiment illustrated in FIGS. 1 and 2, the shield 78 is illustrated folded back against the jacket 80 and is sandwiched between a conductive sleeve 136 and the jacket. The channel 98 comprises a first leg 138 and an opposite second leg 140. Legs 138 and 140 are bendable. Legs 138 and 140 are illustrated in FIG. 2 as being folded around and in engagement with the sleeve 136 to provide mechanical and electrical connection between the shell 82 and the shield 78.

Figure 5:
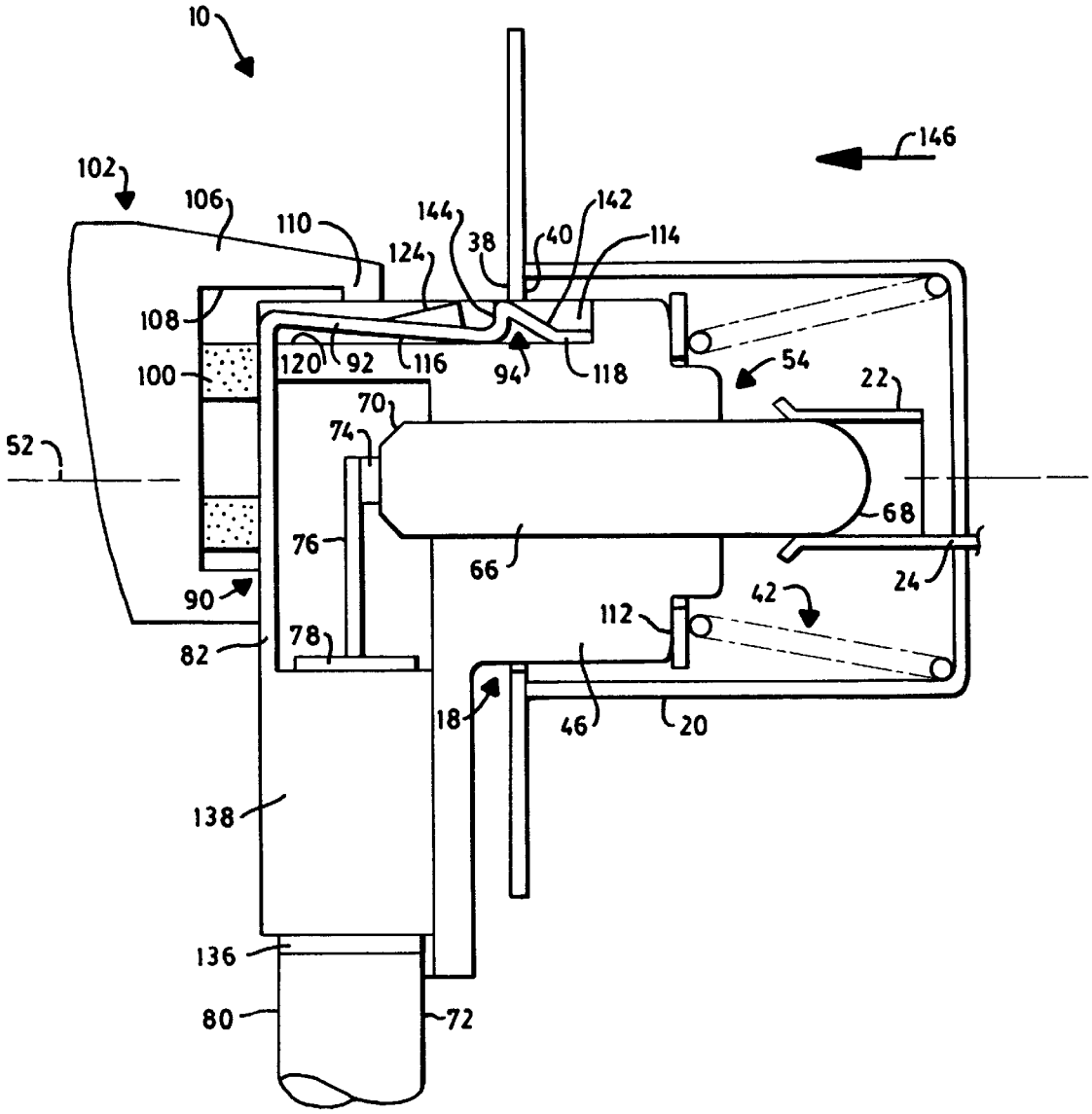
FIG. 5 is a sectional view that illustrates the connector assembly of FIG. 1 in a disengaging mode.
Figure 6:
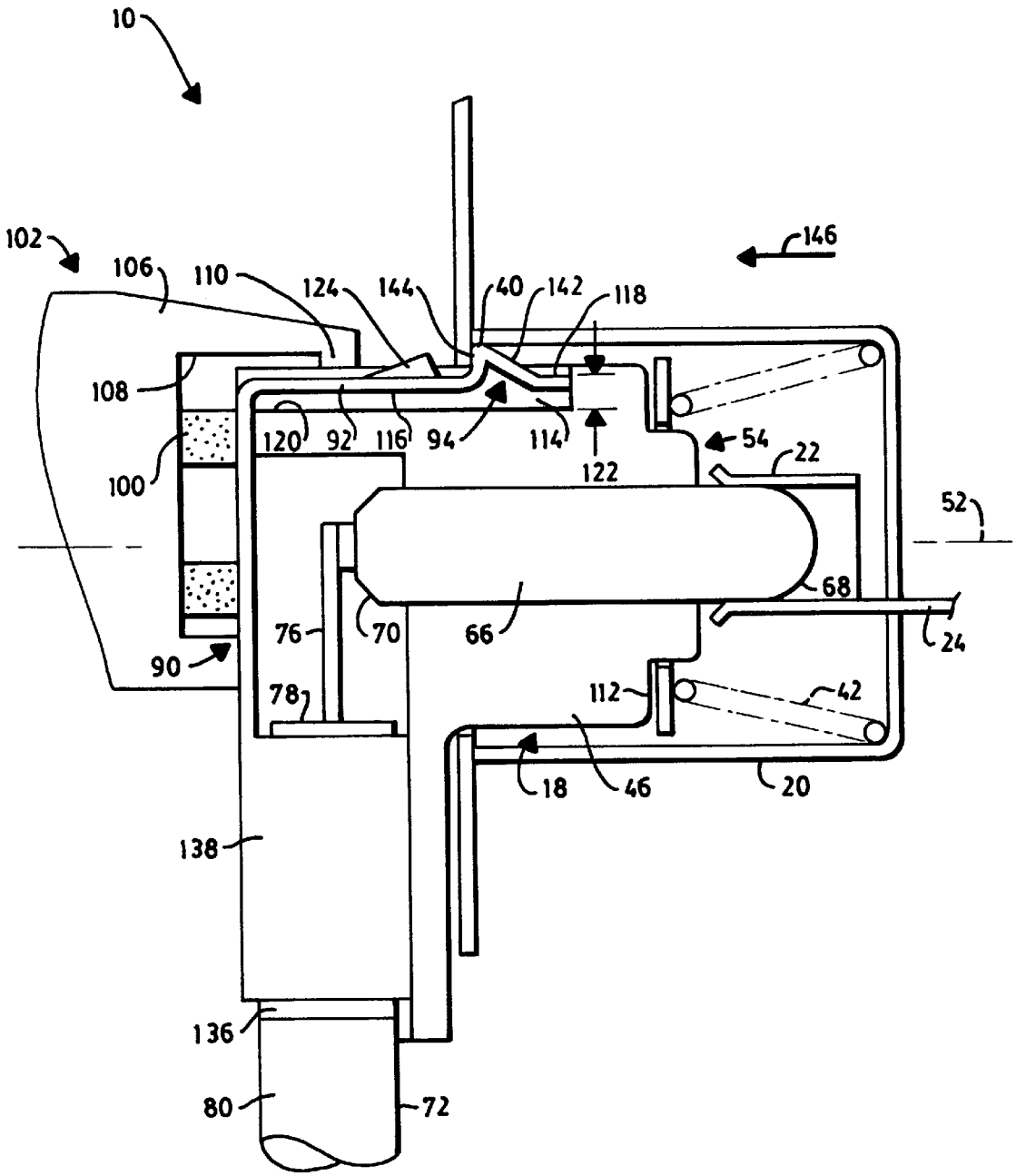
FIG. 6 is a sectional view that illustrates the connector assembly of FIG. 1 in an engaging mode.

Use of the connector 12 with the mating connector 14 will now be explained assuming that the connector 12 has been assembled. In particular, the shell 82, with the actuator 102 attached thereto, has been attached to the insulator 46, the central conductor 76 has been soldered to the contact 66 at 74, the braid 78 has been sandwiched between the sleeve 136 and the jacket 80, and the legs 138 and 140 have been folded around and in engagement with the sleeve 136 and disposed within the channel 58, as described herein. With reference to FIG. 5, in an engaging mode the actuator 102 will be urged away from the actuation end 90 by the resilient element 100 such that the flange 110 of the wall 106 does not engage the raised ramps 124 of the beams 92. When the actuator 102 is so positioned, the connector 12 is moved towards the connector 14 such that the end 54 of the insulator 46 is inserted into the socket 18. During such movement, a portion of the surface 112 of the insulator 46 will engage and depress the spring element 42, and the lip 38 will engage ramps 142 of latch elements 94 and cam the resilient beams 92 and latch elements 94 toward axis 52 as illustrated in FIG. 5. With reference to FIG. 6, continued movement of the insulator 46 into the socket 18 will eventually permit the beams 92 to resile away from axis 52 as the latch elements 94 snap into place such that abutment surfaces 144 of the latch elements engage the abutment surface 40 of the lip 38. The snapping into place of the latch element abutment surface 144 relative to the lip abutment surface 40 provides the user with tactile feedback indicating that the engagement between connectors 12 and 14 is complete. The compressed spring element 42 will urge the insulator 46 in direction 146 causing the abutment surfaces 144 to bear against the abutment surface 40 to provide a firm engagement between the connectors 12 and 14. During insertion of the insulator 46 into the socket 18, if the connectors 12 and 14 are not fully engaged the spring element 42 will urge the connector 12 out of the socket 18.

When it is desired to disconnect the connectors 12 and 14 in a disengaging mode, the actuator 102 may be moved towards the engagement end 88 in the manner illustrated in FIG. 3 thereby compressing the resilient element 100 and causing the flange 110 to engage the raised ramps 124 and thereby cam the resilient beams 92 and latch elements 94 towards axis 52 such that abutment surfaces 40 and 144 are disengaged. The connector 12 may then be disconnected from the connector 14 by moving the insulator 44 out of the socket 18.

The embodiments that have been described herein are but some of several that utilize this invention and are set forth here by way of illustration but not of limitation. It is apparent that many other embodiments that will be readily apparent to those skilled in the art may be made without departing materially from the spirit and scope of this invention.

I claim:

1. A connector comprising:

a housing comprising an insulator extending in a first direction of a longitudinal axis from a front end to a rear end, and an appendage comprising a first channel extending from said insulator in a second direction that extends at an angle relative to said axis;

a contact extending through said insulator in said first direction from one end to another end, said one end and said another end being structured and arranged, respectively, for electrical connection with a mating contact, of a mating connector, extending in said first direction, and a conductor extending through said first channel in said second direction;

a conductive shell comprising a first portion extending in said first direction from an engagement end to an opposite actuation end and attachable to said insulator, said first portion comprising at least one resilient beam extending in said first direction towards said engagement end, said beam comprising a first latch element attachable to said mating connector, and a second portion, comprising a second channel, extending in said second direction and structured and arranged for insertion into said first channel to retain said conductor between said first channel and said second channel;

a resilient element adjacent said actuator end; and an actuator attached to said first portion at said actuation end and slidable in said first direction towards and away from said front end, said resilient element being disposed between said actuator and said first portion and providing resilience for said actuator relative to said actuation end, said actuator being (a) engagable with said beam when urged towards said front end against said resilience to pivot said beam and said first latch element towards said axis in a first mode, and (b) disengagable from said beam when urged by said resilient element away from said first end thereby permitting said beam and said first latch element to resile away from said axis in a second mode.

2. The connector of claim 1 wherein said insulator comprises an outer surface comprising at least one depression extending in said first direction, between said engagement end and said actuation end, said beam comprising a segment extending towards said front end, said segment being substantially entirely disposed within said depression, said distal end comprising a raised portion extending radially away from said axis and out of said depression, said raised portion comprising said first latch element.

3. The connector of claim 2 wherein said beam comprises a raised ramp, said actuator being (a) engaged with said raised ramp in said first mode to pivot said beam and said first latch element towards said axis, and (b) disengagable from said raised ramp in said second mode permitting said beam and said first latch element to resile away from said axis.

4. The connector of claim 3 wherein said first portion comprises at least one tab extending in said first direction towards said engagement end, said tab comprising a second latch element, and further wherein said insulator comprises at least one recess, each recess being in alignment with said tab and comprising a mating third latch element engagable with said second latch element for attachment of said front portion to said insulator.

5. The connector of claim 4 wherein said tab is substantially entirely disposed within said recess.

6. The connector of claim 1 wherein said resilient element comprises an elastomeric element.

7. The connector of claim 1 wherein said actuation end comprises a shoulder, and further wherein said actuator comprises a wall structured and arranged to snap-fit over said shoulder toward said engagement end, in said first direction, said wall being slidable relative to said first portion towards said engagement end in said first mode, and slidable relative to said first portion away from said engagement end and into abutment with said shoulder in said second mode.

8. The connector of claim 1 wherein said second channel is structured and arranged for electrical connection to a shield length of said conductor.

9. The connector of claim 8 wherein said second channel comprises a first leg and a second leg that are bendable to provide said connection.

10. The connector of claim 3 wherein said first latch element comprises an abutment surface facing said actuator end.

11. A connector assembly, comprising:

a first connector comprising a first housing and a first contact contained within said first housing, said first contact electrically and mechanically connected to a first circuit; and a second connector electrically and mechanically connectable to, and disconnectable from, said first connector in an engaging mode and a disengaging mode, respectively, said second connector comprising:

a second housing comprising an insulator extending in a first direction of a longitudinal axis from a front end to a rear end, and an appendage comprising a first channel extending from said insulator in a second direction that extends at an angle relative to said axis;

a second contact extending through said insulator in said first direction from one end to another end, said one end and said another end being structured and arranged, respectively, for electrical connection with said first contact, said first contact extending in said first direction, and a conductor extending through said first channel in said second direction;

a conductive shell comprising a first portion extending in said first direction from an engagement end to an opposite actuation end and attachable to said insulator, said first portion comprising at least one resilient beam extending in said first direction towards said engagement end, said beam comprising a first latch element attachable to said first housing, and a second portion, comprising a second channel, extending in said second direction and structured and arranged for insertion into said first channel and retaining said conductor between said first channel and said second channel;

a resilient element adjacent said actuator end; and an actuator attached to said first portion at said actuation end and slidable in said first direction towards and away from said front end, said resilient element being disposed between said actuator and said first portion and providing resilience for said actuator relative to said actuation end, said actuator being (a) engagable with said beam when urged towards said front end against said resilience to pivot said beam and said first latch element towards said axis in said disengaging mode, and (b) disengagable from said beam when urged by said resilient element away from said first end thereby permitting said beam and said first latch to resile away from said axis in said engaging mode.

12. The connector of claim 11 wherein said insulator comprises an outer surface comprising at least one depression extending in said first direction between said engagement end and said actuation end, said beam comprising a segment extending towards said front end, said segment being substantially entirely disposed within said depression, said distal end comprising a raised portion extending radially away from said axis and out of said respective depression, said raised portion comprising said first latch element.

13. The connector of claim 12 wherein said beam comprises a raised ramp, said actuator being (a) engaged with said raised ramp in said disengaging mode to pivot said beam and said first latch element towards said axis, to disengage said first latch element from said first connector, and (b) disengagable from said raised ramp in said second mode permitting said beam and said first latch element to resile away from said axis, and said first latch element to engage said first connector.

14. The connector of claim 13 wherein said first portion comprises at least one tab extending in said first direction towards said engagement end, said tab comprising a second latch element, and further wherein said insulator comprises at least one recess, said recess being in alignment with said tab and comprising a mating third latch element engagable with said second latch element for attachment of said front portion to said insulator.

15. The connector of claim 14 wherein said tab is substantially entirely disposed within said recess.

16. The connector of claim 11 wherein said resilient element comprises an elastomeric element.

17. The connector of claim 11 wherein said actuation end comprises a shoulder, and further wherein said actuator comprises a wall structured and arranged to snap-fit over said shoulder towards said engagement end, in said first direction, said wall being slidable relative to said first portion towards said engagement end in said first mode, and slidable relative to said first portion away from said engagement end and into abutment with said shoulder in said second mode.

18. The connector of claim 11 wherein said conductor is a coaxial cable, and wherein said second channel is structured and arranged for electrical connection to a shield length of said cable.

19. The connector of claim 18 wherein said second channel comprises a first leg and a second leg, and said cable comprises a shield folded back upon a cable jacket, said shield being disposed between said jacket and a cable sleeve, said first leg and said second leg being foldable around said sleeve.

20. The connector of claim 13 wherein said first latch comprises a first abutment surface facing said actuator end, and further wherein said first housing extends from a forward end to an opposite rearward end and comprises a lip adjacent said forward end, said lip comprising a second abutment surface facing said rearward end, said first connector further comprising a spring element disposed within said first housing, said first abutment surface mating with said second abutment surface, and said spring element being compressed and urging said second abutment member against said first abutment member in said engaging mode, and said spring element resiling and urging said first connector away from said rearward end in said disengaging mode.

* * * * *